US009187282B2

(12) United States Patent
Meyer

(10) Patent No.: US 9,187,282 B2
(45) Date of Patent: Nov. 17, 2015

(54) WINDING DEVICE

(75) Inventor: Helmut Meyer, Troisdorf (DE)

(73) Assignee: Reifenhäuser GmbH & Co. KG Maschinenfabrik, Troisdorf (DE)

( * ) Notice: Subject to any disclaimer, the term of this patent is extended or adjusted under 35 U.S.C. 154(b) by 785 days.

(21) Appl. No.: 12/924,080

(22) Filed: Sep. 20, 2010

(65) Prior Publication Data

US 2011/0101150 A1 May 5, 2011

(30) Foreign Application Priority Data

Sep. 18, 2009 (EP) ..... 09011920

(51) Int. Cl.
*B65H 27/00* (2006.01)

(52) U.S. Cl.
CPC ..... *B65H 27/00* (2013.01); *B65H 2301/5132* (2013.01); *B65H 2301/5133* (2013.01); *B65H 2404/1122* (2013.01); *B65H 2404/1313* (2013.01); *B65H 2404/1314* (2013.01); *B65H 2404/18* (2013.01); *B65H 2701/1752* (2013.01)

(58) Field of Classification Search
USPC ..... 242/541.4, 547, 548, 615.2, 615.4
See application file for complete search history.

(56) References Cited

U.S. PATENT DOCUMENTS 3,207,506 A * 9/1965 Limberger ..... 271/3.19
3,405,855 A * 10/1968 Daly et al. ..... 242/615.4
3,618,436 A * 11/1971 Brown ..... 83/37
3,840,224 A * 10/1974 Zawiski ..... 271/263
4,083,326 A * 4/1978 Kroll et al. ..... 399/281
4,150,773 A * 4/1979 Fell et al. ..... 226/192
4,382,673 A * 5/1983 Nakajima et al. ..... 399/101
4,770,227 A * 9/1988 Sporenberg et al. ..... 164/423
4,824,091 A * 4/1989 Knight ..... 271/178
4,920,439 A * 4/1990 Bordignon ..... 360/130.21
4,988,087 A * 1/1991 Sardano et al. ..... 271/314
5,307,971 A * 5/1994 Evans ..... 226/168
5,529,564 A * 6/1996 Hediger ..... 493/413
5,553,806 A * 9/1996 Lucas ..... 242/542.4
5,582,361 A * 12/1996 Muller et al. ..... 242/542.4

(Continued)

FOREIGN PATENT DOCUMENTS

DE 296 15 385 U1 1/1997
DE 102005000661 * 7/2006 ..... B65H 27/00

(Continued)

OTHER PUBLICATIONS

Chinese Notification of Second Office Action (2 pages) with English translation (3 pages), Dec. 11, 2014, CCPIT Patent and Trademark Law Office, Beijing, China.

(Continued)

*Primary Examiner* — Emmanuel M Marcelo
*Assistant Examiner* — Justin Stefanon
(74) *Attorney, Agent, or Firm* — Pauley Erickson & Kottis

(57) ABSTRACT

A winding device for winding a continuously arriving material web onto a reel, including a contact roller by which the material web can be guided and transferred to the reel in contact with the surface of the contact roller. The contact roller has a support tube and fibers, which protrude from the outside of the support tube and form the surface of the contact roller. The fibers extend essentially perpendicular to a longitudinal axis of the contact roller so that first ends of the fibers are affixed to the support tube and their other free ends define a surface of the contact roller.

24 Claims, 3 Drawing Sheets

(56) References Cited

U.S. PATENT DOCUMENTS

| | | | | |
|---|---|---|---|---|
| 5,660,349 | A * | 8/1997 | Miller et al. | 242/526.1 |
| 5,805,961 | A * | 9/1998 | Mizoe et al. | 399/174 |
| 6,056,230 | A * | 5/2000 | Peters et al. | 242/541.5 |
| 6,149,099 | A | 11/2000 | Meinecke et al. | |
| 6,338,453 | B1 | 1/2002 | Meyer | |
| 6,612,829 | B2 | 9/2003 | Rübhausen | |
| 6,666,998 | B2 | 12/2003 | Berghaus et al. | |
| 6,751,056 | B1 * | 6/2004 | Anderson et al. | 360/128 |
| 6,752,348 | B2 | 6/2004 | Dreckmann et al. | |
| 6,954,983 | B2 | 10/2005 | Fröschl et al. | |
| 6,991,758 | B2 | 1/2006 | Krumm et al. | |
| 7,025,303 | B2 | 4/2006 | Meyer | |
| 7,036,763 | B2 | 5/2006 | Böhm et al. | |
| 7,093,785 | B2 | 8/2006 | Meyer et al. | |
| 7,384,254 | B2 | 6/2008 | Rübhausen et al. | |
| 7,445,443 | B2 | 11/2008 | Meyer | |
| 7,479,003 | B2 | 1/2009 | Wedell et al. | |
| 8,069,525 | B2 * | 12/2011 | Brenken | 15/182 |
| 8,468,921 | B2 * | 6/2013 | Ruhland et al. | 83/347 |
| 8,663,079 | B2 * | 3/2014 | Zeitz | 492/50 |
| 2002/0086071 | A1 | 7/2002 | Rubhausen | |
| 2002/0180111 | A1 | 12/2002 | Steinberg et al. | |
| 2004/0166192 | A1 | 8/2004 | Stommel | |
| 2007/0028741 | A1 * | 2/2007 | Ruhland et al. | 83/659 |
| 2009/0028618 | A1 * | 1/2009 | Kabata et al. | 399/346 |
| 2010/0104677 | A1 | 4/2010 | Spirgatis et al. | |
| 2010/0136152 | A1 | 6/2010 | Spirgatis et al. | |
| 2010/0143516 | A1 | 6/2010 | Spirgatis et al. | |
| 2010/0295207 | A1 | 11/2010 | Thewes et al. | |

FOREIGN PATENT DOCUMENTS

| | | | | |
|---|---|---|---|---|
| DE | 102006032086 | * | 1/2008 | B65H 18/26 |
| EP | 1 574 465 | A1 | 9/2005 | |
| EP | 1 679 275 | A1 | 7/2006 | |
| EP | 1 947 044 | A1 | 7/2008 | |
| GB | 2 109 430 | A | 6/1983 | |
| JP | 4-56143 | | 2/1992 | |
| JP | 5-66657 | | 3/1993 | |
| JP | 06114507 | A * | 4/1994 | B22D 11/06 |
| JP | 06186751 | A * | 7/1998 | G03F 7/30 |
| JP | 11-505795 | | 5/1999 | |
| JP | 11-180605 | | 7/1999 | |
| JP | 2004359422 | A * | 12/2004 | B65H 5/06 |
| JP | 2007-176653 | | 7/2007 | |

OTHER PUBLICATIONS

Chinese Second Office Action (5 pages) , Dec. 11, 2014, CCPIT Patent and Trademark Law Office, Beijing, China.

Chinese Search Report (2 pages) with English translation (2 pages), Dec. 11, 2014, CCPIT Patent and Trademark Law Office, Beijing, China.

* cited by examiner

WINDING DEVICE

BACKGROUND OF THE INVENTION

1. Field of the Invention

This invention relates to a winding device for winding a continuously arriving material web onto a reel, including a contact roller by which the material web can be guided and transferred to the reel that contacts the surface of the contact roller.

2. Discussion of Related Art

Winding devices are generally widely known and are used, for example, to continuously wind an arriving material web constructed on a basis of a synthetic film or a synthetic fleece web. Depending on the design, in such a winding device, the contact roller is in a surface contact with the developing reel of the material web, for example the material web, by being wrapped partially around the surface of the contact roller, and is guided by the latter and transferred to the reel at the contact point with the reel.

In this design of a winding device, problematic diametrical differences in the developing reel occur, which are due, for example, to thickness fluctuations in the material web. These are compounded in the wound reel and as a result, the contact roller then only contacts the highest radial points of the reel because the contact roller is required to be very rigid for stability reasons. Such a contact at only certain points between the contact roller and the reel results in a subsequent uneven reel development, culminating in the occurrence of so-called blockage points or winding blemishes, which would appear in need of improvement.

In order to solve the above-mentioned problem, attempts have been made to provide the contact rollers with a surface that is soft and therefore compensates for thickness tolerances, for example by providing the contact roller with a sandwich construction that has an inner, hard support tube and an outer, soft casing, such as described in German Patent Reference DE 296 15 385 U1. However, these designs do not always perform in a satisfactory fashion. In addition, European Patent Reference EP 1 679 275 A1 has already proposed providing a cloth casing for rollers that are used to guide film webs, but this casing does not behave in a satisfactory fashion, particularly in the region of the contact roller, where friction occurs between the contact roller and the reel resting against it.

European Patent Reference EP 1 947 044 A1 describes a contact roller with a soft inner layer and a comparatively harder outer layer.

SUMMARY OF THE INVENTION

One object of this invention is to modify a winding device with a contact roller so that even in reels in which diametrical tolerances cause unevenness, a particularly uniform winding result is assured.

This object is attained according to this invention by a proposed embodiment of a winding device as discussed in this specification and in the claims. Other advantageous embodiments and modifications of this invention are the discussed in this specification and in the claims.

According to this invention, the contact roller of the winding device has a support tube and on the outside, has fibers that protrude from the support tube and form the surface of the contact roller. The fibers extend essentially perpendicular to a longitudinal axis of the contact roller so that the first ends of the fibers are affixed to the support tube and the other free ends define the surface of the contact roller.

Thus according to this invention, the support tube, which is comprised of a sufficiently rigid, dimensionally stable material such as steel, aluminum, or CFK, has fibers protruding from it in the region of its surface across which the material web is guided, and resting on the free ends of these fibers, the material web is guided on its way to the reel. Due to the elasticity of such fibers, the entire contact roller has a very high elasticity, giving the roller the capacity to compensate for diametrical tolerances in the reel in a surprisingly simple and effective manner. Even large diametrical fluctuations are not a problem. At the same time, the elastic fibers give the proposed contact roller according to this invention an extraordinarily good damping capacity.

According to another embodiment of this invention, the fibers of the contact roller are combined into a multitude of discrete fiber bundles, which facilitates production and also makes it easier to influence the property profile of the fibers.

Specific properties of the contact roller proposed according to this invention can be varied through the selection of the fiber material, fiber length, fiber thickness, fiber shape, and offset, which will be explained in greater detail below.

According to one embodiment of this invention, the fibers of the contact roller have a length from 1 mm to 250 mm. In the context of this invention, it is possible to use only fibers of a uniform length in a contact roller and it is also possible to use fibers of different lengths.

According to another embodiment of this invention, the fibers of the contact roller have a diameter of 0.001 mm to 1.0 mm. It is thus possible to use only fibers of a uniform diameter in a contact roller and it is also possible to use fibers of different diameters.

Fibers with a greater length and/or smaller diameter give greater flexibility or elasticity to the surface of the contact roller proposed according to this invention.

The fibers of the contact roller proposed according to this invention can be based on a synthetic or based on animal hair, yielding further possibilities for influencing the property profile. According to one embodiment of this invention, the fibers can be embodied as or equipped to be electrically conductive in order to provide the contact roller with an electrical conductivity and, for example, to inhibit static charges.

In applications in which an electrical charge of the material web is desired, the material for the fibers can also be appropriately selected to produce an electrical charging of the material web. Examples of suitable materials for producing fibers that charge the material web include polyamide synthetics.

Also, the fibers can be offset in relation to the surface of the support tube and for example can protrude from the surface of the support tube inclined at an angle either in the rotation direction of the contact roller or opposite its rotation direction.

It is also possible for the fibers to be offset in the width direction of the contact roller, such as in the direction of its longitudinal axis, so that it is also possible to exert a spreading action on the material web to be wound.

The longitudinal span of the offset fibers can either be straight or curved.

According to another embodiment of this invention, the fibers of the contact roller can also be crimped, thus making it possible to achieve a greater fiber density at the surface of the contact roller.

According to another embodiment of this invention, the support tube of the winding device according to this invention is divided into a plurality of segments along its longitudinal span so that each has fibers protruding from the outside and they jointly form the contact roller. In this embodiment of this invention, the contact roller of the winding device according to this invention is thus not a one-piece support tube with fibers or fiber bundles protruding from the outside. Instead, the support tube is of a plurality of segments that are joined to one another and jointly form the contact roller.

In the above-described embodiment of the support tube of the winding device according to this invention, with a segmented division of the support tube, it is possible to easily manufacture contact rollers with different roller widths because it is then only necessary to join together the appropriate number of segments, which can have a standardized width, thus facilitating production.

In addition, it is possible to adapt the contact roller to changing product widths of the material webs being processed on the winding device according to this invention.

In the event of wear on the fibers or fiber bundles positioned on the support tube segments, it is possible to specifically replace only those segments that are worn, thus reducing maintenance costs.

In addition, the proposal according to this invention to embody the support tube so that it is of a plurality of segments joined to one another also permits an even more precise matching and adaptation to the respective given facts of the current product. It is also possible to provide similar fibers on all segments of the support tube, particularly for all of the segments that are used to form the contact roller to be embodied the same as one another. However, it is also possible to embody the fibers or fiber bundles positioned on the individual segments differently from one another, for example in the context of the above-mentioned explanations, with different fiber hardnesses and/or lengths and/or different diameters as well as different material selections, different offsets, and the like. In addition, the individual segments can have the same or different widths.

A segmented construction can achieve a high degree of flexibility while also reducing costs.

According to another embodiment of this invention, the adjoining segments of the support tube can be joined to one another in a form-locking fashion, for example so that their adjoining regions respectively have engaging projections and corresponding recesses to assure a form-locking engagement of the same kind as an end surface denticulation. The segments that end up in the respective end positions in the longitudinal span of the support tube, such as the outer segments of the support tube, can be clamped in relation to each other by corresponding clamping devices.

According to another embodiment of this invention, the segments are arranged on a common axle.

It is also possible, depending on the required property profile, to embody the surface of the contact roller of the winding device according to this invention differently, such as in a cylindrical or also spherical form, including a concave or convex form.

BRIEF DESCRIPTION OF THE DRAWINGS

Other embodiments and details of this invention are explained in greater detail below in view of exemplary embodiments shown in the drawings, wherein.

DETAILED DESCRIPTION OF THE INVENTION

Figure 2:
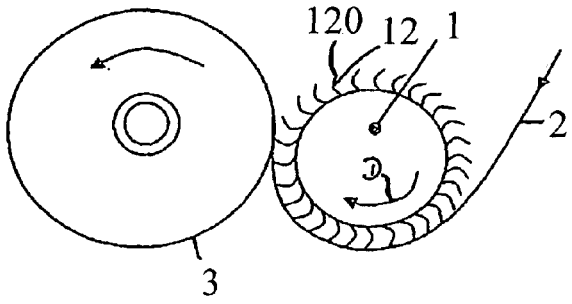
FIG. 2 shows a schematic diagram of a first exemplary embodiment of a winding device according to this invention.
Figure 3:
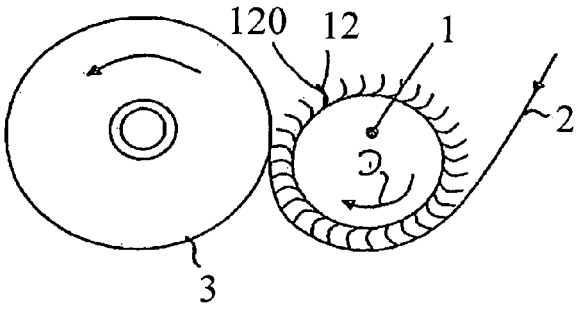
FIG. 3 shows a schematic diagram of a second exemplary embodiment of a winding device according to this invention.

FIGS. 2 and 3 schematically show a winding device for winding a continuously arriving material web 2, for example a film web coming from an extrusion device. The material web 2 is guided in the winding device by being wound partially around the surface of a contact roller 1 in surface contact with a reel 3 that is formed by the wound material web 2. The rotation direction of the contact roller 1 is indicated by the arrow D.

Figure 1:
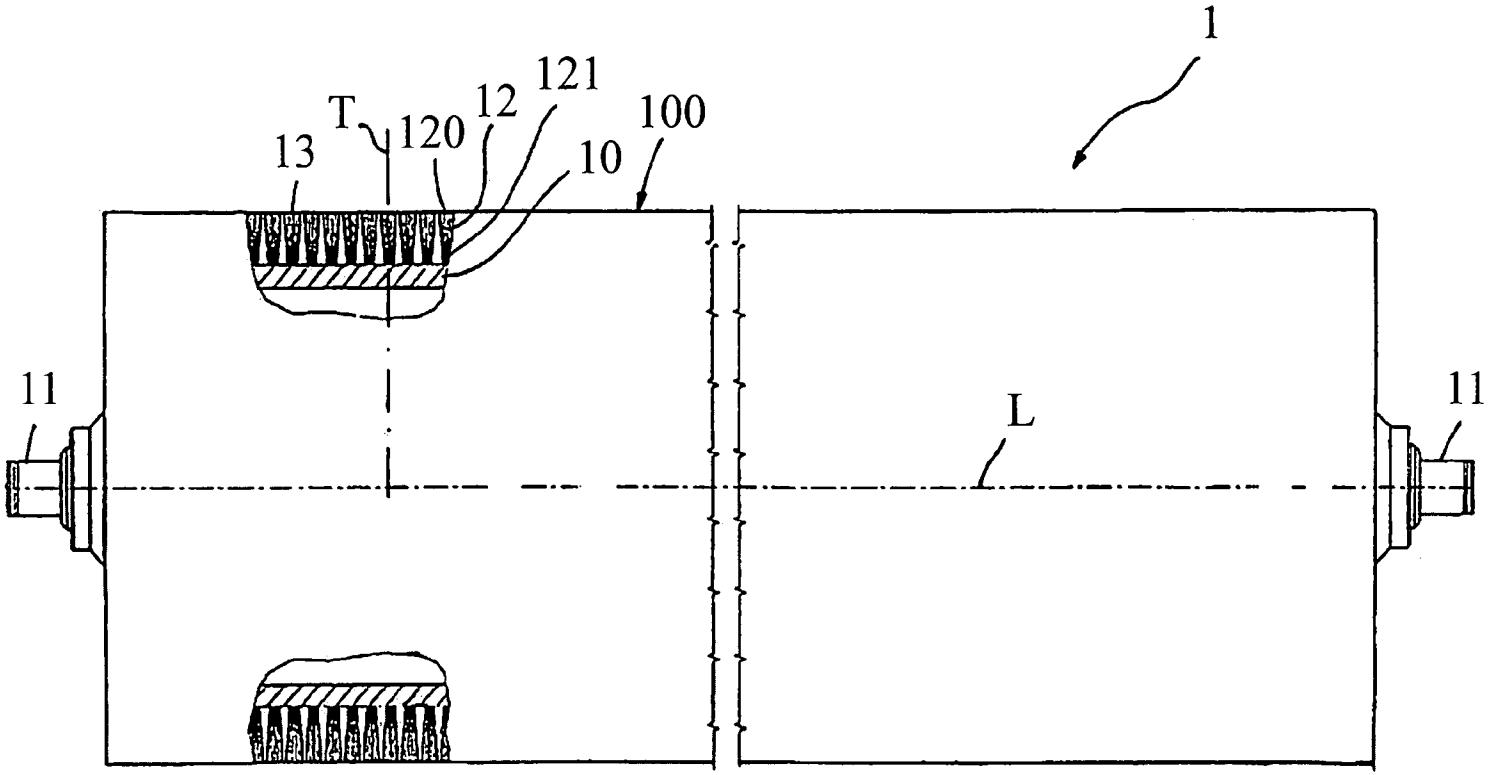
FIG. 1 shows a partial sectional front view of a contact roller used in a winding device according to this invention.
Figure 4:
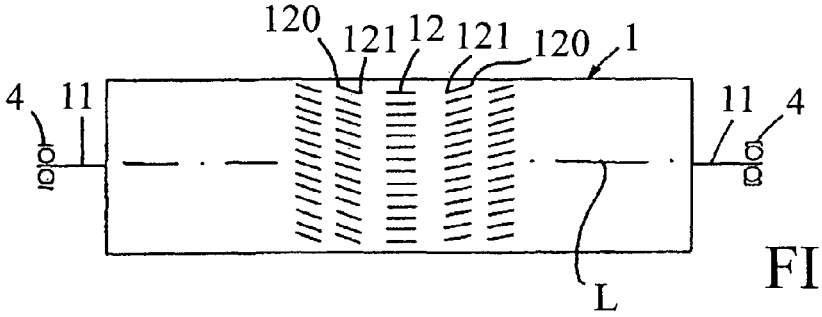
FIG. 4 shows a schematic diagram of another embodiment of the winding device according to this invention.
Figure 5:
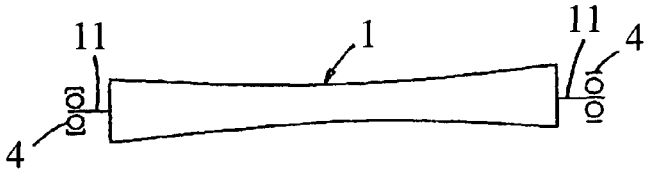
FIGS. 5 and 6 each shows a different surface embodiment of the contact roller of the winding device according to this invention.
Figure 6:
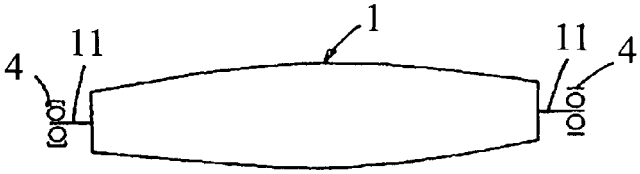

As shown in greater detail in FIG. 1, the contact roller 1 includes a rigid support tube 10, for example made of stainless steel, which has bearing journals 11 at its two ends in a direction of the longitudinal axis L for supporting it in rotary bearings 4 shown, for example, in FIGS. 4 through 6. In lieu of the bearing journals 11 shown here, it is also possible to provide the contact roller 1 with internal bearings.

Fibers 12, a certain number of which are combined to form discrete fiber bundles 13, are mounted on an outside of the support tube 10.

Each fiber 12 of the fiber bundles 13 in this case extends essentially in a direction of an axis T that extends perpendicular to the longitudinal axis L of the contact roller 1, such as the first ends 121 of the fibers 12 affixed to the support roller 10 and their other, free ends 120 protruding from the support roller 10, defining the surface 100 of the contact roller 1 via which the material web 2 is guided and transferred to the reel 3.

Because of the intrinsic elasticity of the fibers 12, the entire surface 100 of the contact roller 1 is this elastically flexible and is in a position to compensate for diametrical tolerances over the width of the developing reel 3 and to assure a continuous contact with the reel 3 over the entire width of the contact roller 1, even when there are significant diametrical fluctuations along its longitudinal axis.

In the exemplary embodiment according to FIG. 1, with the exception of a slightly conical orientation of the fibers to one another within individual fiber bundles 13, the fibers 12 each extend in a straight line and essentially or generally perpendicular to the longitudinal axis L of the contact roller 1, whereas in the exemplary embodiment according to FIG. 2, the individual fibers 12 are offset so that the free ends 120 of the individual fibers 12 point in the rotation direction D of the contact roller.

The reverse is true in the exemplary embodiment according to FIG. 3. In this case, the free ends 120 of the fibers 12 point in a direction opposite from the rotation direction D of the contact roller 1.

This offset of the fibers 12 significantly increases the flatness of the material web guided across the surface 100 of the contact roller 1. The fibers 12 can also be crimped to further improve the surface coverage of the contact roller 1 with the fibers 12.

The winding result of a winding device equipped with or having such a contact roller 1 also benefits from the fact that air inclusions and bubble formation cannot occur on the surface of the contact roller 1 under the material web 2. An adhesion of sticky film webs, for example, to the surface of the contact roller 1 is also effectively inhibited.

In the exemplary embodiment according to FIG. 4, an offset of the fibers 12 in the direction of the longitudinal axis, such as in the width direction of the contact roller 1, is visible. Starting from a neutral central region in the direction toward the two ends of the contact roller 1, the fibers are inclined at an angle in the direction of the longitudinal axis L and inclined at an angle in the rotation direction D or opposite from it. Such an orientation of the fibers 12 stretches the material web 1 in the direction of its width as it is guided across the surface 100 of the contact roller 1, which can positively influence the winding result and can also influence the property profile of the material web in a desired way.

Figure 7:
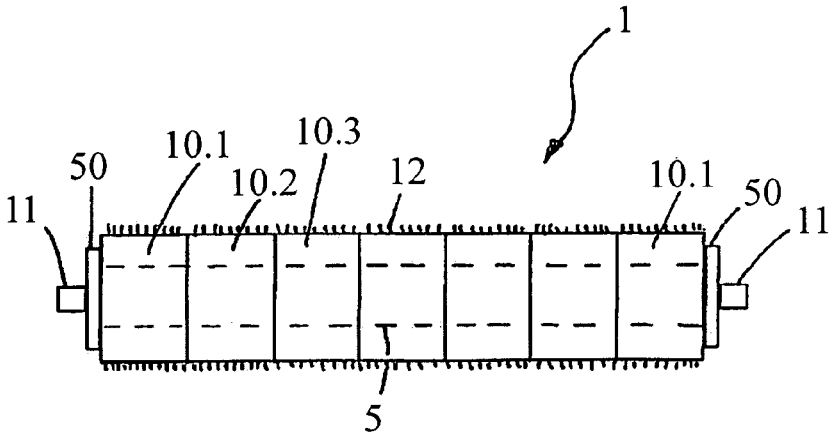
FIG. 7 shows another embodiment of the contact roller according to this invention.

FIG. 7 shows another embodiment of a contact roller 1.

By contrast with the contact roller 1 shown in FIG. 1, which features a one-piece construction of the support tube 10 with the fibers 12 protruding from the outside, in the exemplary embodiment according to FIG. 7, starting from the two bearing journals 11, a continuous common axle 5 is provided, onto which a plurality of segments of the support tube 10, which are labeled 10.1, 10.2, 10.3, for example, are slid so that they adjoin one another. The segments 10.1, 10.2, 10.3 each has fibers 12 protruding from the outside. The fibers 12 can be embodied so that they are a same or a different number, size, diameter, material, hardness and/or orientation, as compared to those of the other segments.

Clamping plates 50 that are mounted on the common axle 5 clamp the segments 10.1 situated at the respective ends in the longitudinal direction L of the contact roller 1, for example at the outer ends, in relation to each other so that the adjoining segments 10.1, 10.2, 10.3 are pressed against one another along their interstices and thus jointly form the support tube 10, with the fibers 12 protruding from the outside of the support tube 10.

In a way not shown, an end surface denticulation with corresponding projections and recesses can also be provided between adjacent segments 10.1, 10.2, 10.3 in order to assure a form-locked connection between the segments 10.1, 10.2, 10.3 that adjoin one another.

With such a contact roller 1, which is embodied as segmented and is shown in FIG. 7, it is possible to use different fiber configurations on the individual segments in order to adapt to the given facts of a particular product. For example, in order to compensate for bending of the contact roller 1, it is possible to provide the outer segments 10.1 with fibers 12 that are softer than those situated on the inner segments.

In the event of wear, it is possible to specifically replace only those segments in which the replacement is required due to wear, whereas other segments can continue to be used, thus reducing the maintenance complexity and operating costs.

It is also possible to adapt the total width of the contact roller 1 in a simple way, for example, when there is a change in the width of the material web 2 to be processed or as part of the mass production of such contact rollers, which are of standardized segments. It is only necessary to change the number of segments connected in series on the common axle 5.

The individual segments 10.1, 10.2, 10.3 can be embodied not only with the same or different fibers 12, but also with the same or different widths.

As shown in FIGS. 5 and 6, the overall surface of the contact roller 1 can be embodied not only in a cylindrical form, as in the exemplary embodiment according to FIG. 1, but also in a spherical form, for example a convex form, as shown in FIG. 5 or also a concave form, as shown in FIG. 6.

European Patent Application 09011920.7/EP09011920, filed 18 Sep. 2009, the priority document corresponding to this invention, to which a foreign priority benefit is claimed under Title 35, United States Code, Section 119, and its entire teachings are incorporated, by reference, into this specification.

What is claimed is:

1. A winding device for winding a continuously arriving material web (2) of synthetic film or synthetic fleece web around a reel (3), the winding device comprising: a contact roller (1) with a contact surface (100) by which the material web (2) is guidable by being wound partially around the contact surface (100) and transferable to the reel (3) in contact with the contact surface (100) of the contact roller (1), the contact roller (1) including: a support tube (10) having a length between opposing support tube ends and a circumference, and fibers (12) protruding from an outside of the support tube (10) continually along an entirety of the length and circumference of the support tube (10), the fibers including first ends (121) affixed to the support tube (10) and free ends disposed away from the support tube (10), wherein the free ends form an entirety of the contact surface (100) of the contact roller (1), wherein the contact surface (100) is the only surface of the contact roller that contacts the material web (2), the reel (3) including a reel contact surface formed by the material web (2) wound around the reel (3), wherein the contact surface (100) contacts the reel contact surface along a longitudinal width of the reel contact surface at a point of material web transfer from the contact roller (1) to the reel (3).

2. The winding device as recited in claim 1, wherein the fibers (12) of the contact roller (1) are combined into a multitude of discrete fiber bundles (13).

3. The winding device as recited in claim 2, wherein the fibers (12) of the contact roller (1) have a length from 1 mm to 250 mm.

4. The winding device as recited in claim 3, wherein the fibers (12) of the contact roller (1) have a diameter from 0.001 mm to 1.0 mm.

5. The winding device as recited in claim 4, wherein the fibers (12) of the contact roller (1) are synthetic or based on animal hair.

6. The winding device as recited in one of claim 5, wherein the fibers (12) of the contact roller (1) are electrically conductive.

7. The winding device as recited in claim 6, wherein the fibers (12) of the contact roller (1) are positioned offset in a rotation direction (D) of the contact roller (1) or are offset in an opposite direction.

8. The winding device as recited in claim 7, wherein the fibers (12) of the contact roller (1) are positioned offset in a direction of the longitudinal axis (L) of the contact roller (1).

9. The winding device as recited claim 8, wherein the fibers (12) of the contact roller (1) are crimped.

10. The winding device as recited claim 9, wherein the support tube (10) is divided along a longitudinal span (L) into a plurality of segments (10.1, 10.2, 10.3) each having fibers (12) protruding from the outside and jointly forming the contact roller (1).

11. The winding device as recited in claim 10, wherein adjacent segments (10.1, 10.2, 10.3) of the support tube (10) are connectible to one another in a form-locked fashion.

12. The winding device as recited in claim 11, wherein the segments (10.1, 10.2, 10.3) are positioned on a common axle (5).

13. The winding device as recited in one of claim 12, wherein the segments (10.1, 10.2, 10.3) have the same or different fibers (12).

14. The winding device as recited in claim 13, wherein the surface (100) of the contact roller (1) is cylindrical, concave or convex.

15. The winding device as recited in claim 1, wherein the fibers (12) of the contact roller (1) have a length from 1 mm to 250 mm.

16. The winding device as recited in claim 1, wherein the fibers (12) of the contact roller (1) have a diameter from 0.001 mm to 1.0 mm.

17. The winding device as recited in claim 1, wherein the fibers (12) of the contact roller (1) are synthetic or based on animal hair.

18. The winding device as recited in one of claim 1, wherein the fibers (12) of the contact roller (1) are electrically conductive.

19. The winding device as recited in claim 1, wherein the fibers (12) of the contact roller (1) are positioned offset in a rotation direction (D) of the contact roller (1) or are offset in an opposite direction.

20. The winding device as recited in claim 1, wherein the fibers (12) of the contact roller (1) are positioned offset in a direction of the longitudinal axis (L) of the contact roller (1).

21. The winding device as recited claim 1, wherein the fibers (12) of the contact roller (1) are crimped.

22. The winding device as recited claim 1, wherein the support tube (10) is divided along a longitudinal span (L) into a plurality of segments (10.1, 10.2, 10.3) each having fibers (12) protruding from the outside and jointly forming the contact roller (1).

23. The winding device as recited in claim 22, wherein adjacent segments (10.1, 10.2, 10.3) of the support tube (10) are connectible to one another in a form-locked fashion.

24. The winding device as recited in claim 1, wherein the surface (100) of the contact roller (1) is cylindrical, concave or convex.

* * * * *